United States Patent [19]

Sung

[11] Patent Number: 4,551,152

[45] Date of Patent: Nov. 5, 1985

[54] ALCOHOL FUEL ANTI-WEAR ADDITIVE

[75] Inventor: Rodney L. Sung, Fishkill, N.Y.

[73] Assignee: Texaco Inc., White Plains, N.Y.

[21] Appl. No.: 718,580

[22] Filed: Apr. 1, 1985

[51] Int. Cl.[4] ..... C10L 1/22

[52] U.S. Cl. ..... 44/78; 44/53; 44/56; 252/403; 252/404

[58] Field of Search ..... 44/78, 56, 53; 252/403, 252/404

[56] References Cited

U.S. PATENT DOCUMENTS 3,927,994 12/1975 Romans ..... 44/78

*Primary Examiner*—Y. Harris-Smith

*Attorney, Agent, or Firm*—Robert A. Kulason; James J. O'Loughlin; Vincent A. Mallare

[57] ABSTRACT

A novel fuel composition contains methanol or methanol/gasoline blends plus, as a wear-inhibiting additive, a reaction product of an aldehyde, e.g., paraformaldehyde, and N-alkyl-alkylene diamine, e.g., N-alkyl-1,3-propane diamine with a salicylic acid ester of a polyol, e.g., alpha-hydroxy-omega hydroxy-poly (oxyethylene) poly (oxypropylene) poly (oxyethylene) block copolymer.

20 Claims, No Drawings

ALCOHOL FUEL ANTI-WEAR ADDITIVE

FIELD OF THE INVENTION

This invention relates to alcohols, and more particularly to alcohol-containing fuels characterized by a decreased ability to corrode/wear metal surfaces with which they come in contact.

BACKGROUND OF THE INVENTION

As is well know to those skilled in the art, alcohol substances such as methanol or methanol fuels may cause corrosion and wear of metal surfaces with which they come in contact.

This problem can be quite severe in internal combustion engines where alcohol-containing fuels are burned. It is therefore important to develop an additive to inhibit this problem causing wear and corrosion. In addition, it is imperative that all problems (i.e., storage tanks, lines, etc.) are overcome before the use of alcohol and alcohol-containing fuels become more prevalent.

Thus, it is an object of this invention to provide a novel additive for decreasing the corrosion/wear of alcohol compositions. Other objects will be apparent to those skilled in the art.

SUMMARY OF THE INVENTION

In accordance with certain of its aspects, the novel fuel composition of this invention may comprise (a) a major portion of a fuel containing a $C_1$–$C_2$ alcohol and 0–50 volumes of gasoline per volume of alcohol; and (b) a minor wear-inhibiting amount of, as a wear-inhibiting additive, a condensate product of the process comprising:

(i) reacting a polyol $$HO(CH_2CH_2O)_a(\underset{\substack{|\\ CH_3}}{CH}CH_2O)_b(CH_2CH_2O)_cH$$

wherein a+c is 1–20 and b is 5–50 with a carboxy phenol, thereby forming an ester;

(ii) reacting said ester with an aldehyde and an N-alkyl-alkylene diamine, thereby forming a condensate product; and (iii) recovering said condensate product.

DESCRIPTION OF THE INVENTION

The fuel for internal combustion engines which may be treated by the process of this invention may contain (1) at least one $C_1$–$C_2$ alcohol, e.g, ethanol or methanol, and (2) gasoline in an amount of 0 to 50 volumes per volume of alcohol. The fuel may be an alcohol-type fuel containing little or no hydrocarbon. Typical of such fuels are methanol, ethanol and mixtures of methanol-ethanol, etc. Commercially available mixtures may be employed. The fuels which may be treated by the process of this invention also include the gasohols which may be formed by mixing 90–95 volumes of gasoline with 5–10 volumes of ethanol or methanol. A typical gasohol may contain 90 volumes of gasoline and 10 volumes of absolute alcohol.

It is preferred that the fuels to be treated by the process of this invention be substantially anhydrous, i.e., that they contain less than about 0.3 v% water; typically, they may contain about 0.0001 to about 0.05 v%, say about 0.04 v% water. In accordance with the practice of the process of this invention, there may be added to the fuel a minor wear-inhibiting amount of, as a wear-inhibiting additive, a condensate product of the process comprising:

(1) reacting a polyol with a carboxy phenol, thereby forming an ester;

(2) reacting the ester with an aldehyde or ketone and an N-alkyl-alkylene diamine, thereby forming a condensate product; and (3) recovering the condensate product.

The polyol may be represented by the formula:

$$HO(CH_2CH_2O)_a(\underset{\substack{|\\ CH_3}}{CH}CH_2O)_b(CH_2CH_2O)_cH$$

wherein a+c is 1 to 20 and b is 5 to 50. The molecular weight of the polyol may range from about 800 to about 2000. Examples of the polyols which may be employed herein include those listed below in Table I.

TABLE I

A. The Wyandotte Pluronic L-31 brand of poly(oxyethylene) poly(oxypropylene) poly(oxyethylene) polyol having a molecular weight $\overline{M}_n$ of 950 and containing 10 w % derived form poly(oxyethylene) and 90 w % derived from poly(oxypropylene). In this product, b is 14.7 and a+c is 2.2.

B. The Wyandotte Pluronic L-63 brand of poly(oxyethylene) poly(oxypropylene) poly(oxyethylene) polyol having a molecular weight $\overline{M}_n$ of 1750 and containing 30 w % derived from poly(oxyethylene) and 70 w % derived from poly(oxypropylene). In this product, b is 21.1 and a+c is 11.9.

C. The Wyandotte Pluronic L-62 brand of poly(oxyethylene) poly(oxypropylene) poly(oxyethylene) polyol having a molecular weight $\overline{M}_n$ of 1750 and containing 20 w % derived from poly(oxyethylene) and 80 w % derived from poly(oxypropylene). In this product b is 24.1 and a+c is 8.

D. The Wyandotte Pluronic L-43 brand of poly(oxyethylene poly(oxypropylene) poly(oxyethylene) polyol having a molecular weight $\overline{M}_n$ 1200 and containing 30 w % derived from poly(oxyethylene) and 70 w % derived from poly(oxypropylene). In this product b is 16.6 and a+c is 5.5.

E. The Wyandotte Pluronic L-64 brand of poly(oxyethylene) poly(oxypropylene) poly(oxyethylene) polyol having a molecular weight $\overline{M}_n$ 1750 and containing 40 w % derived from poly(oxyethylene) and 60 w % derived from poly(oxypropylene). In this product b is 18.1 and a+c is 15.9.

The carboxy phenol may be one bearing a carboxy group on the hydroxy benzene ring which may be derived from alkyl, aryl, alkaryl, aralkyl, or cycloalkyl benzene. The carboxy phenols which may be used herein include those listed below in Table II.

TABLE II o-salicylic acid
m-salicylic acid
p-salicylic acid

The aldehydes or ketones which may be employed may be characterized by the formulas, $$R^*CHO \text{ or } R_2^{**}CO$$

Wherein R* is H or a $C_1$–$C_{10}$ hydrocarbon group and R** is a $C_1$–$C_{10}$ hydrocarbon group. The hydrocarbon group is the aldehyde or ketone may be aliphatic or aromatic including alkyl, aryl, alkaryl, aralkyl, or cycloalkyl in nature. Illustrative aldehydes and ketones which may be employed according to the present invention are listed below in Table III.

TABLE III acetaldehyde
formaldehyde
propion aldehyde
butyraldehyde
cyclohexaldehyde
benzaldehyde
acetone
methyl ethyl ketone
acetophenone The amines which may be employed in the present process include polyamines preferably diamines, which bear at least one primary amine-$NH_2$ group and at least one substituted primary amine group. The latter may be di-substituted, but more preferably it is mono-substituted. The hydrocarbon nucleus of the amine may be aliphatic or aromatic including alkyl, alkaryl, aralkyl, aryl, or cyclalkyl in nature. The preferred amine may be of the formula:

$$R'—NH—R''—NH_2$$

wherein R' is a $C_{12}$–$C_{18}$ hydrocarbon group and R'' is a $C_1$–$C_3$ hydrocarbon group. In the preferred amines, i.e., mono-substituted primary amines, R' may be an alkyl, alkaryl, aralkyl, aryl, or cycloalkyl hydrocarbon group and R'' may be an alkylene, aralkylene, alkarylene, arylene, or cycloalkylene hydrocarbon group.

Illustrative of the preferred N-alkyl-alkylene diamines may include those listed below in Table IV.

TABLE IV

A. The Duomeen O brand of N-oleyl-3,-propane diamine.
B. The Duomeen S brand of N-stearyl-1,3-propane diamine.
C. The Duomeen T brand of N-tallow-1,3-propane diamine.
D. The Duomeen C brand of N-coco-1,3-propane diamine.

The most preferred diamine, R'—NH—R''—$NH_2$, is that where the R'' group is propylene, —$CH_2CH_2CH_2$— and the R' group is a $C_{12}$–$C_{18}$ n-alkyl group.

It will be apparent to those skilled in the art that several reactants may be inert substituents which are typified by alkyl, alkoxy, halogen, nitro, cyano, haloalkyl, etc. It will also be apparent that the preferred compounds to be employed will be those which are soluble in the solvents employed during the reaction in which produced products which are soluble in a solvent compatible with the system in which the product is to be employed.

Typical solvents which may be employed include cyclohexane, xylene, mixture of xylene, and toluene and mixtures of toluene. The formulation of the desired additives may preferably be effected by placing equimolar quantities of salicylic acid and a polyol in a reaction vessel in an excess of solvent in the presence of a catalytic amount of p-toluene-sulfonic acid. A typical solvent (e.g., xylene) may be present in the amount of 5 to 500 parts depending upon the N-alkyl-alkylene diamine used. Typically, the reactions for preparing the additives may be as illustrated below.

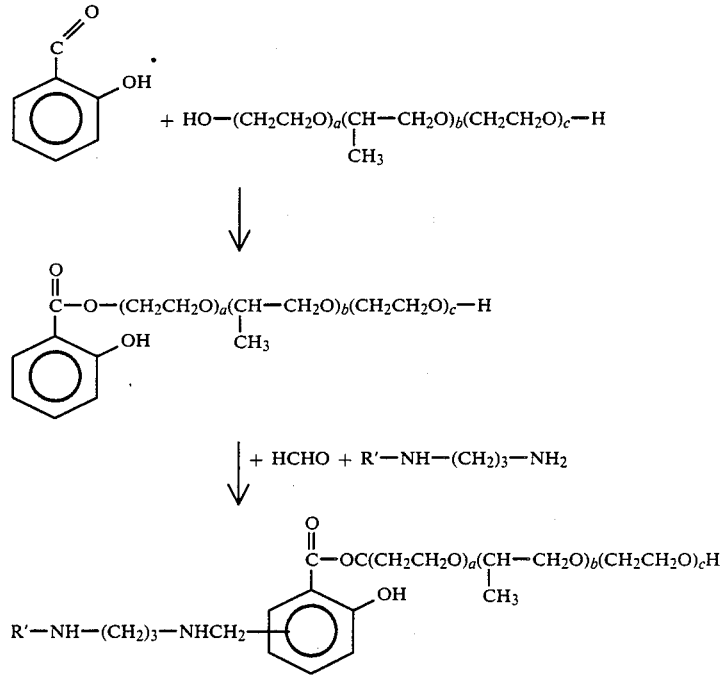

wherein R' is a $C_{12}$–$C_{18}$ hydrocarbon group and a+c is 1–20, preferably 2–5 and more preferably about 2.2; and b is 5–50, preferably 10–20 and more preferably about 14.7.

The reaction mixture is refluxed and azeotroped for 8 to 24 hours, preferably for 16 hours at a pot temperature of 150° to 180° C., preferably about 170° C. under nitrogen. About 5 to 25 milliliters of water is removed from the reaction, preferably about 9 milliliters. The reaction mixture is cooled to 60° C. Then the aldehyde, preferably paraformaldehyde, is added. After the addition of the paraformaldehyde, the reaction mixture may be refluxed and azeotroped at a pot temperature of 120° to 180° C., preferably about 150° C. for 2 hours, and 5 to 36 milliliters of water may be removed, preferably about 14 milliliters. The reaction mixture is filtered and stripped under a vacuum. The residue is then recovered in a yield approaching stoichiometric.

The anti-wear additives prepared according to the present invention may be added to fuels (including alcohol, gasoline, gasohol etc.) or to antifreeze. These compositions may be particularly found to be effective when added to absolute alcohol fuels.

Also, the prepared anti-wear additives may be added to a fuel in a minor wear-inhibiting amount of about 0.003–10.0 wt.%, preferably about 0.01–8.0 wt.%, more preferably about 0.2–6.0 wt.%, and most preferably about 0.5 wt.%.

It is a feature of this invention that the fuel composition is characterized by its increased ability to significantly reduce scar diameters (wear) in the Four-Ball Wear Test.

The Four Ball Wear Test is carried out by securely clamping three highly polished steel balls (each 0.5 inch in diameter) in a test cup in an equilateral triangle in a horizontal plane. The fourth highly polished steel ball, resting on the three lower balls to form a tetrahedron, is held in a chuck. A weight lever arm system applies weight to the test cup, and this load holds the balls together. In the standard test, the speed of rotation is 1800 rpm; the load is 5 kilograms. The assembly is submerged in the liquid to be tested. The standard test is carried out at ambient temperature for 30 minutes. As the chuck and upper ball rotate against the fixed lower balls, the friction of the upper ball rotating in relation to the lower balls produces a wear-scar the diameter of which (i.e. the depth along a diameter of the ball) is measured. The average of the wear on the three lower balls is the rating assigned (in millimeters).

It is observed that the use of the technique of this invention permits reduction in the average scar diameter by as much as 25%–35%. A reduction of 10% is a significant reduction.

DESCRIPTION OF PREPARED EMBODIMENTS

The practice of this invention will be apparent to those skilled in the art from the following examples wherein, as elsewhere in this specification, all parts are parts by weight unless otherwise specified.

EXAMPLE I

Into a reaction vessel were added 69 parts of salicylic acid, 170 parts of xylene and one part of p-toluene sulfonic acid. To this mixture, 475 parts of poly(oxyethylene poly(oxypropylene) poly(oxyethylene) polyol were added. The mixture was refluxed and azeotroped for 16 hours under nitrogen at a pot temperature of 160° to 180° C. and about 7.0 ml of water was removed. The mixture was cooled to 25° C. Then 20 parts of paraformaldehyde and 187 parts of N-tallow-1,3-diamine were added. The mixture was then refluxed and azeotroped for 20 hours at a pot temperature of 155° C. with 13.0 ml of water removed. The reaction mixture was then filtered and stripped. The residue contained 1.9% nitrogen with a TBN of 38.5. A test formulation was made up containing 100% methanol which contained 0.5 wt.% of the above reaction product. This formulation was subjected to the Four Ball Test. The average scar diameter as about 0.26 mm.

EXAMPLE II 69 parts of salicylic acid, 170 parts of xylene and one part of p-toluene sulfonic acid were mixed in a reaction vessel. To this mixture, 475 parts of poly(oxyethylene) poly(oxypropylene) poly(oxyethylene) polyol were added. The resulting mixture was refluxed and azeotroped for about 10 hours under nitrogen at a pot temperature of 120° to 180° C. with 8 ml of water removed. The mixture was cooled to room temperature and 23 parts paraformaldehyde and 13.8 parts N-coco-1,3-propane diamine were added. Refluxing and azeotroping of the mixture were resumed until 9 ml of water were moved.

A test formulation was made up containing 100% methanol which contained 0.5 wt.% of the above reaction product. This reaction product was subjected to the Four Ball Test. The average scar diameter was about 0.29 mm. The reaction mixture was then filitered and stripped. The residue contained 2.1% nitrogen with a TBN of 83.6.

EXAMPLE III 69 parts of salicylic acid, 170 parts xylene and one parts of p-toluene sulfonic acid were mixed in a reaction vessel. To this mixture, 475 parts of poly(oxyethylene) poly(oxypropylene) poly(oxyethylene) polyol were added and the mixture was refluxed and azeotroped under nitrogen for about 16 hours at 120° to 180° C. At the end of this time 8 ml of water were removed. To this mixture 23 parts of paraformaldehyde and 160.6 parts of N-oleyl-1,3-propane diamine were added.

A test formulation was made up containing 100% methanol which contained 0.5 wt.% of the above reaction product. This formulation was subjected to the Four Ball Test. The average scar diameter was 0.27. Refluxing and azeotroping of the product were resumed and 9 ml of water were removed. The mixture was filtered and stripped and the residue contained 2% nitrogen with a TBN of 80.3.

EXAMPLE IV

In this Example, the test procedure of Example 1 was used except there was no additive used. The mixture of the material of this Example is 100% methanol.

A test formulation of each of the products of Examples I, II, and III were made up containing 100% absolute methanol, making up 0.5 wt.% of each product. These formulations, as well as the material of this Example, were subjected to the Four Ball Test and the results are recorded below in Table V.

TABLE V

| EXAMPLE | AVERAGE SCAR DIAMETER (mm) |
|---|---|
| I | 0.26 |
| II | 0.29 |
| III | 0.27 |
| IV | 0.41 |

It is apparent from the results shown in Table V above that the preferred embodiment of the present invention (Example I) increased the wear-inhibiting property of the methanol by over 150 (i.e. 0.41/0.26)

and the less preferred embodiment of this invention (Example II) gave a lesser degree of improvement of about 140 (i.e., 0.41/0.29) which is still substantial.

It has been found that results comparable to those in Example I may be obtained when the added components are as provided in the Examples shown below in Table VI.

TABLE VI

| Example | Additive** |
|---|---|
| (V) | $C_{12}H_{18}-NH-(CH_2)_4-NH_2$ + 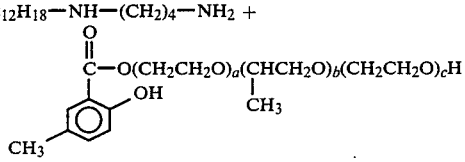 |
| (VI) | $C_{18}H_{22}-NH-CH_2CH_2CH_2-NH_2$ + 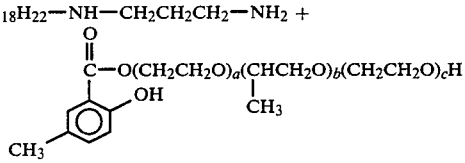 |
| (VII) | $C_{16}H_{33}NHCH_2Ch_2CH_2NH_2$ + 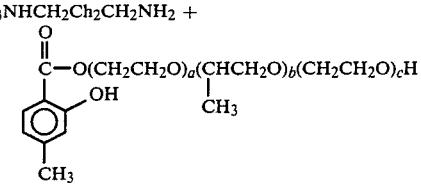 |
| (VIII) | $C_{18}H_{37}NH-CH_2CH_2CH_2-NH_2$ + 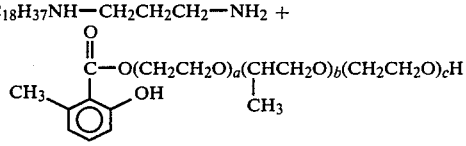 |

**where a + c is 1–20 and b is 5–50.

Also, results may be comparable to those of Example I, if the fuel used is as those listed below in Table VII.

TABLE VII

| EXAMPLE | FUEL |
|---|---|
| IX | Absolute Methanol |
| X | Methanol/Gasoline Blend (90.5 v % gasoline; 4.75 v % cosolvent; 4.75 v % methanol) |
| XI | Gasohol (90 v % gasoline; 10 v % ethanol) |

Although this invention has been illustrated by reference to specific embodiments, it will be apparent to those skilled in the art that various changes and modifications may be made clearly following the scope of this invention as defined in the appended claims.

I claim:

1. A fuel composition for an internal combustion engine comprising:

(a) a major portion of a fuel containing (i) a $C_1$–$C_2$ alcohol and (ii) 0–50 volumes of gasoline per volume of alcohol; and (b) a minor wear-inhibiting amount of, as a wear-inhibiting additive, a condensate product of the process comprising:

(i) reacting a polyol $$HO(CH_2CH_2O)_a(\underset{\underset{CH_3}{|}}{C}HCH_2O)_b(CH_2CH_2O)_cH$$

wherein a+c is 1–20 and b is 5–50, with a hydroxy aromatic carboxylic acid, thereby forming an ester; and (ii) reacting said ester with an aldehyde and an N-alky-alkylene diamine, thereby forming a condensate product; and (iii) recovering said condensate product.

2. The fuel composition of claim 1, wherein said polyol has a molecular weight $\overline{M}_n$ ranging from about 800 to about 2000.

3. The fuel composition of claim 1, wherein in said polyol a+c is about 2.2 and b is about 14.7.

4. The fuel composition of claim 1, wherein in said polyol a+c is about 11.9 and b is about 21.1.

5. The fuel composition of claim 1, wherein said carboxy phenol has the formula

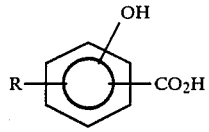

where R is H or a $C_1$–$C_{30}$ hydrocarbon group.

6. The fuel composition of claim 1, wherein said aldehyde has the formula

R*CHO where R* is H or a $C_1$–$C_{10}$ hydrocarbon group.

7. The fuel composition of claim 1, wherein said ketone has the formula

RCO where R is a $C_1$–$C_{10}$ hydrocarbon group.

8. The fuel composition of claim 1, wherein said diamine has the formula $R'-NH-R''-NH_2$ where R′ is a $C_{12}$–$C_{18}$ hydrocarbon group and R″ is a divalent $C_1$–$C_3$ hydrocarbon group.

9. The fuel composition of claim 1, wherein the minor amount ranges from about 0.003 to about 10.0 wt.%.

10. The fuel composition of claim 9, wherein the minor amount ranges from about 0.2 to about 6.0 wt.%.

11. The fuel composition of claim 9, wherein the minor amount is about 0.5 wt.%.

12. The fuel composition of claim 1, wherein said fuel contains about 0.0001 to about 0.05 v% water.

13. The fuel composition of claim 12, wherein said fuel contains about 0.04 v%.

14. A fuel composition for an internal combustion engine comprising:

(a) a major portion of a fuel containing (i) a $C_1$–$C_2$ alcohol and (ii) 0–50 volumes of gasoline per volume of alcohol; and (b) a minor wear-inhibiting amount of, as a wear-inhibiting additive, a condensate product of the process comprising:

(i) reacting a polyol $$HO(CH_2CH_2O)_a(\underset{\underset{CH_3}{|}}{C}HCH_2O)_b(CH_2CH_2O)_cH$$

where a+c is 1–20 and b is 5–50, with a carboxy phenol

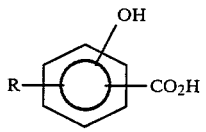

where R is H or a $C_1$–$C_{30}$ hydrocarbon group, thereby forming an ester

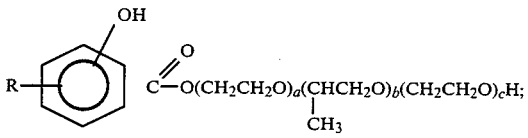

(ii) reacting said ester wih an aldehyde

R*CHO where R* is H or a $C_1$–$C_{10}$ hydrocarbon group, and an N-alky-alkylene diamine $R''—NH—R''—NH_2$ where R′ is a $C_{12}$–$C_{18}$ hydrocarbon group and R″ is a divalent $C_1$–$C_3$ hydrocarbon group, thereby forming a condensate product

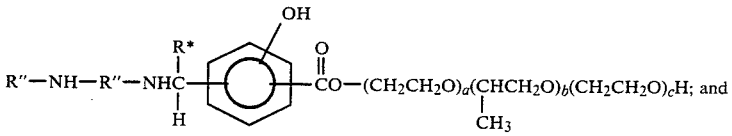

(iii) recovering said condensate product.

15. The fuel composition of claim 14, wherein the minor amount ranges from about 0.003 to about 10.0 wt.%.

16. The fuel composition of claim 15, wherein the minor amount ranges from about 0.2 to about 6.0 wt.%.

17. The fuel composition of claim 15, wherein the minor amount is about 0.5 wt.%.

18. The fuel composition of claim 14, wherein said fuel contains about 0.0001 to about 0.05 v% water.

19. The fuel composition of claim 12, wherein said fuel contains about 0.04 v%.

20. A fuel composition for an internal combustion engine comprising:

(a) a major portion of a fuel containing
  (i) methanol and
  (ii) 45 volumes of gasoline per volume of methanol; and (b) about 10 wt.% of a wear-inhibiting condensate product of the process comprising:
  (i) reacting a polyol $$HO(CH_2CH_2O)_a(\underset{\underset{CH_3}{|}}{C}HCH_2O)_b(CH_2CH_2O)_cH$$

where a+c is about 2.2 and b is about 14.7, with o-salicylic acid; thereby forming an ester

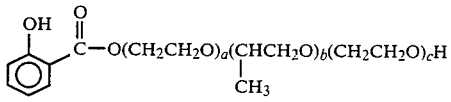

(ii) reacting said ester with paraformaldehyde and N-oleyl-1,3-propane diamine, thereby forming a condensate product

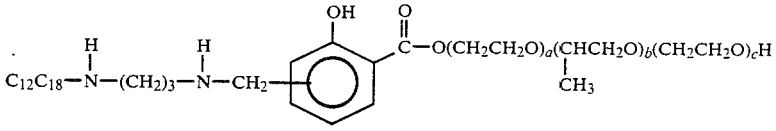

and (iii) recovering said condensate product.

* * * * *